US007096506B2

(12) United States Patent
Ragot

(10) Patent No.: US 7,096,506 B2
(45) Date of Patent: Aug. 29, 2006

(54) GARMENT HAVING AN INTERNAL COLLAR

(75) Inventor: Jean-Marc Ragot, Groisy (FR)

(73) Assignee: Salomon S.A., Metz-Tessy (FR)

( * ) Notice: Subject to any disclaimer, the term of this patent is extended or adjusted under 35 U.S.C. 154(b) by 74 days.

(21) Appl. No.: 10/919,340

(22) Filed: Aug. 17, 2004

(65) Prior Publication Data

US 2005/0010988 A1 Jan. 20, 2005

Related U.S. Application Data

(63) Continuation of application No. PCT/FR03/00418, filed on Feb. 11, 2003.

(30) Foreign Application Priority Data

Feb. 20, 2002 (FR) ..... 02 02235

(51) Int. Cl.
*B63C 11/04* (2006.01)

(52) U.S. Cl. ..... 2/2.15

(58) Field of Classification Search ..... 2/2.15, 2/2.17, 69, 69.5, 123, 127, 128, 129, 135, 2/468, 455, 456, 458, 82
See application file for complete search history.

(56) References Cited

U.S. PATENT DOCUMENTS

| | | | | |
|---|---|---|---|---|
| 4,809,364 A | | 3/1989 | Lent | |
| 5,630,229 A | | 5/1997 | Machado et al. | |
| 5,647,059 A | * | 7/1997 | Uglene et al. | 2/2.15 |
| 5,768,703 A | | 6/1998 | Machado et al. | |
| 5,896,578 A | * | 4/1999 | Hunter et al. | 2/2.15 |
| 5,898,934 A | | 5/1999 | Hunter et al. | |
| 2002/0108160 A1 | | 8/2002 | Griffiths | |

FOREIGN PATENT DOCUMENTS

| | | |
|---|---|---|
| EP | 1221408 A2 | 7/2002 |
| FR | 2769475 A3 | 4/1999 |
| GB | 2312643 A | 11/1997 |
| WO | WO-98/01337 A1 | 1/1998 |
| WO | WO-99/52765 A2 | 10/1999 |
| WO | WO-00/66423 A1 | 11/2000 |

* cited by examiner

*Primary Examiner*—Tejash Patel
(74) *Attorney, Agent, or Firm*—Greenblum & Bernstein, P.L.C.

(57) ABSTRACT

A garment for aquatic sports, including a torso-forming part which includes a front panel and a rear panel, which is provided with openings for the passage of the head, legs, and arms, the garment also including an opening in the form of a slit, provided with a fastening mechanism. The garment includes an internal collar, a main portion of which surrounds the user's neck, the collar being fixed to an inner surface of the torso-forming part.

20 Claims, 4 Drawing Sheets

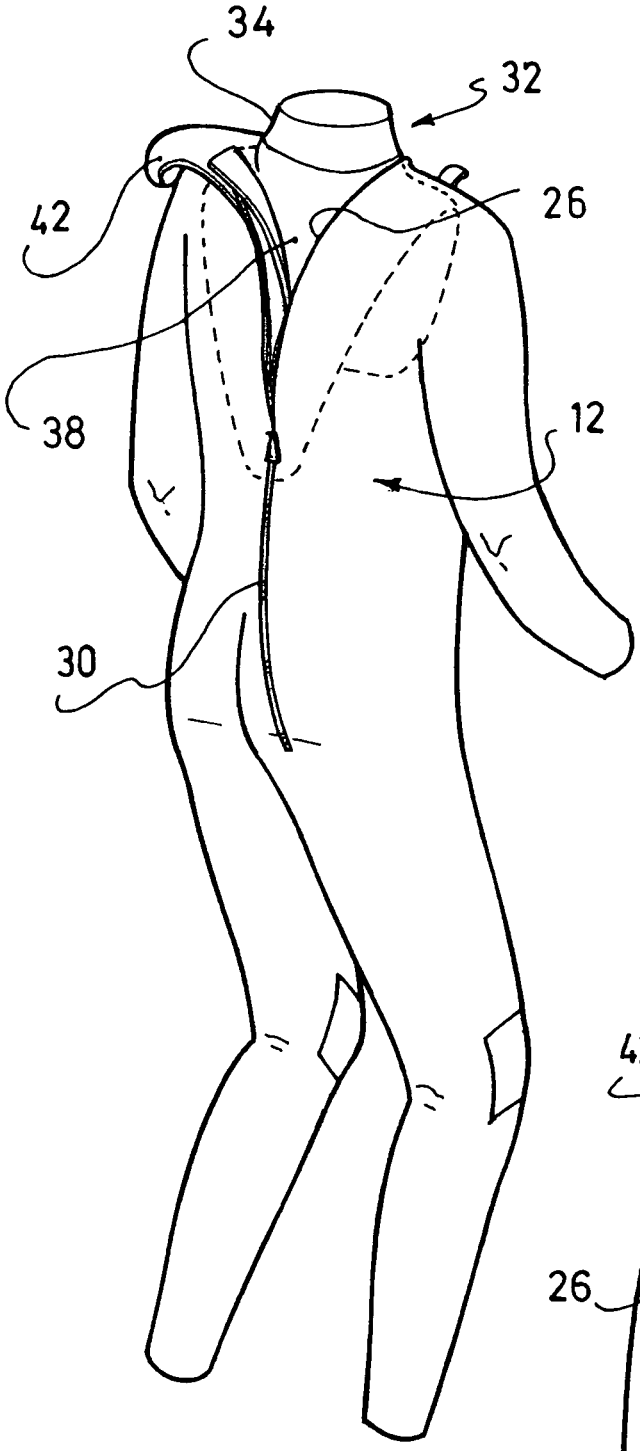
Fig: 3
Fig: 4
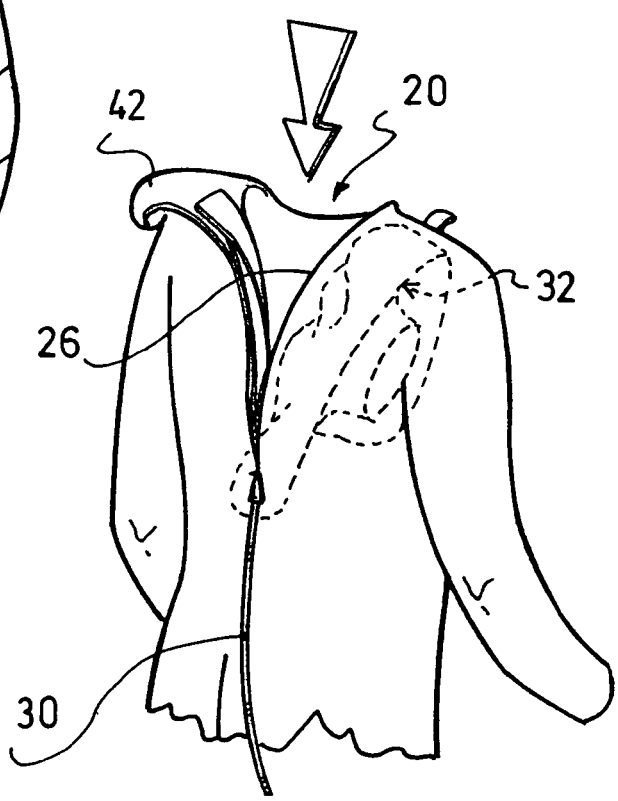

GARMENT HAVING AN INTERNAL COLLAR

CROSS-REFERENCE TO RELATED APPLICATION

This application is a continuation of International Patent Application No. PCT/FR03/00418, having an international filing date of Feb. 11, 2003, the disclosure of which is hereby incorporated by reference thereto in its entirety, and the priority of which is hereby claimed under 35 U.S.C. §120.

This application is based upon French Patent Application No. 02.02235, filed Feb. 20, 2002, the disclosure of which is hereby incorporated by reference thereto in its entirety and the priority of which is hereby claimed under 35 U.S.C. § 119.

BACKGROUND OF THE INVENTION

1. Field of the Invention

The invention relates to aquatic sportswear, in particular sportswear that is generally referred to as wetsuits, and which are more particularly adapted to nautical or underwater sporting activities, such as surfing, board sailing, diving, etc.

2. Description of Background and Relevant Information

Sportswear of the aforementioned type are generally classified in two categories: dry or waterproof suits in which water does not penetrate inside the suit, and wetsuits in which a thin film of water is allowed between the garment and the diver's body, this film being almost instantaneously heated by the diver's body.

Such aquatic suits generally comprise a main portion that covers the torso, a front panel of which covers the front portion of the thorax, and a rear panel covering the back. This main portion that covers the torso includes openings for the passage of the arms, legs, and head. The garment can include sleeves and legs for covering the upper limbs and the lower limbs, respectively.

These garments, in particular wetsuits, are generally made of flexible and elastic material so as to fit the shape of the body as closely as possible without hindering movement of the wearer. For example, these materials can be elastic fabrics (such as fabrics having elasthane), or polychloroprene foams (known under the trademark NEOPRENE®), these materials being capable of being assembled to one another at various locations of the same garment. Depending on the choice of these materials, these garments can offer protection against the cold, impacts, the sun, etc.

Various systems are provided to facilitate the wearer putting on and removing such garments. The most widely used of the systems is that which includes an opening in the form of a slit in the torso-forming part of the garment. This slit is often arranged in the rear panel of the garment, and it extends, for example, vertically along the spine, from the neckline down to the lower back. The slit is provided with fastening arrangement which is generally made in the form of a slide fastener or zipper.

The conventional arrangement for the fastening of the slit poses problems of comfort and imperviousness in the area of the neck and in the area of the slit.

Various alternative embodiments are disclosed in the documents FR-2 769 475, GB-2 312 643, U.S. Pat. No. 4,809,364, U.S. Pat. No. 5,630,229, U.S. Pat. No. 5,768,703, and WO-00/66423. All of these documents describe suits that do not have the slit provided with fastening means to avoid water infiltration. Therefore, these constructions require providing an opening for the passage of the head, at the top of the suit, which is sufficiently large to also allow for the passage of the entire user's body. Imperviousness in the area of this opening is ensured by an external flap that is supposed to be imperviously pressed on the torso-forming part. In certain cases, two superimposed external flaps are even provided. However, these constructions have proven unsatisfactory due much difficulty in putting on the suit due to the lack of a closable slit, on the one hand, and due to the lack of imperviousness in the area of the opening for the passage of the head, on the other hand. Indeed, the flaps are not efficiently pressed against the torso, in particular when the user makes wide movements with the upper limbs.

SUMMARY OF THE INVENTION

In view of the problems associated with known suits of the type mentioned, there is a need for a new design for such sportswear, and particularly for the opening, the fastening, and the sealing of these garments, which would facilitate an ease with which such a garment can be put on and taken off, while preserving the comfort and imperviousness of the garment.

To this end, the invention is directed to a garment for use in aquatic sports in particular. The garment includes a torso-forming part that has a front panel and a rear panel, and is provided with openings for the passage of the head, legs, and arms, as well as an opening in the form of a slit provided with a fastening mechanism. In addition, the garment includes an internal collar, a main portion of which surrounds the user's neck, the collar being fixed to an inner surface of the torso-forming part of the garment.

BRIEF DESCRIPTION OF THE DRAWINGS

Other characteristics and advantages of the invention will become apparent upon reading the detailed description that follows, with reference to the annexed drawings, in which:

FIG. 3 is a three-quarter perspective rear view of the garment of FIG. 1, the garment being open in the area of the slit of the rear panel;

FIG. 4 is a partial view, along the same angle as FIG. 3, showing the collar folded inward, under a shoulder, so as to allow entry of the user's body into the garment;

DETAILED DESCRIPTION OF THE INVENTION

Figure 1:
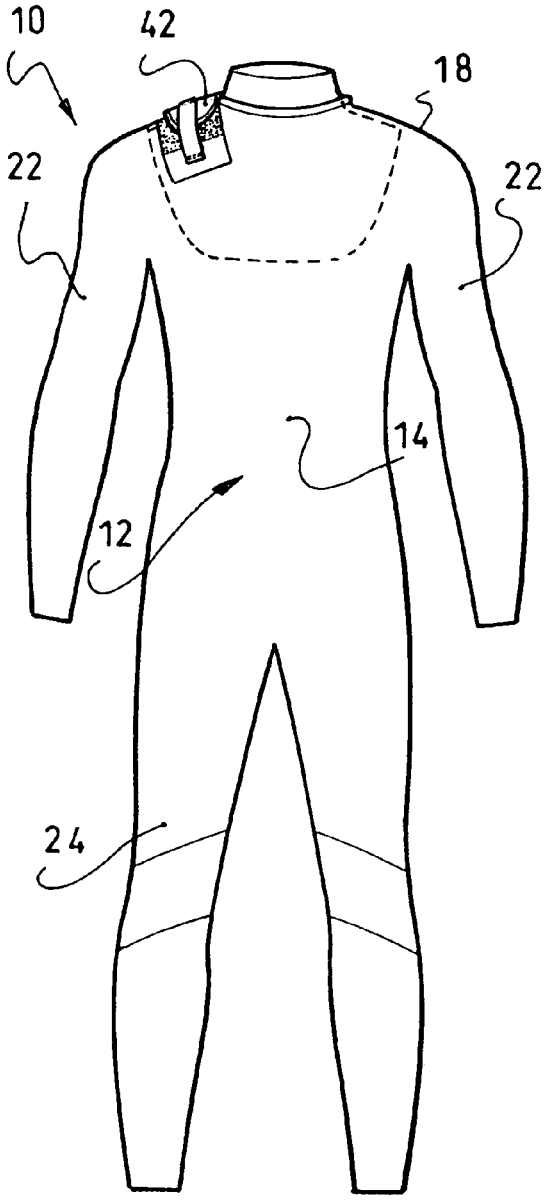
FIGS. 1 and 2 are front and rear views of a garment according to the teachings of the invention, the collar being shown in the position of use.
Figure 2:
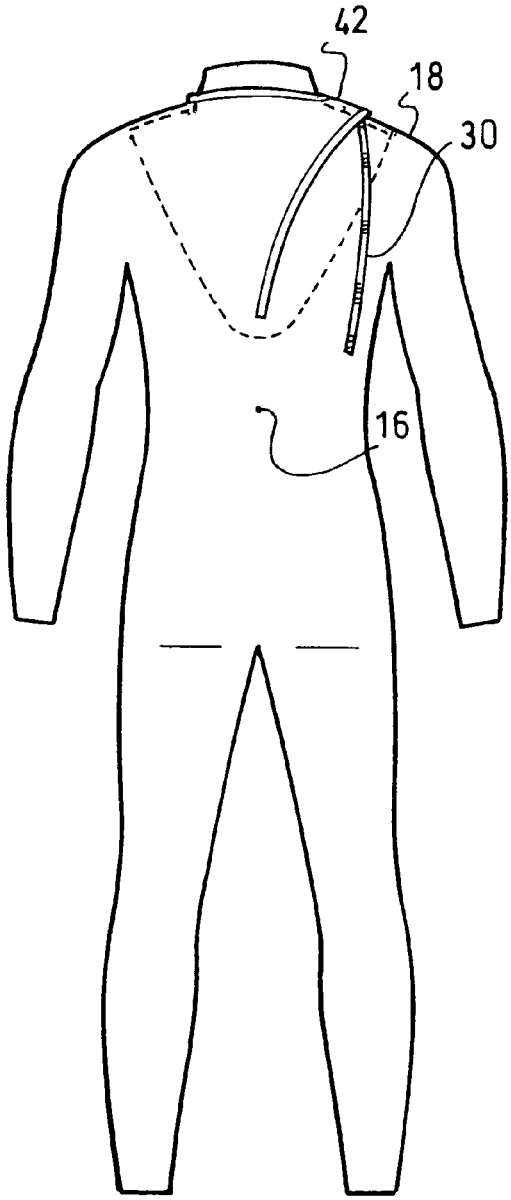

The drawing figures show an aquatic suit, a wetsuit type of garment 10 in particular, that has a main part 12 covering the user's torso or trunk. The torso-forming part 12 includes a front panel 14 covering the front portion of the torso, and a rear panel 16 covering the back. The part 12 includes shoulders 18 on both sides of an opening 20 for the passage of the head. It also includes openings for the passage for the upper and lower limbs; however, in the example shown, the suit is an integral suit, or one-piece suit, that also includes sleeves 22 and legs 24 extending from these openings. The opening 20 for the passage of the head, which forms the upper edge of the front and rear panels, substantially follows the contour of the base of the user's neck. However, this opening could be constituted by the edge of a neck portion that would be integrated into the torso-forming part and which would rise along the user's neck.

For example, the suit is essentially made out of polychloroprene foam (known under the trademark NEOPRENE®), in the form of panels assembled to one another. These panels can have different thicknesses or characteristics depending upon their positioning on the garment. Each panel can itself be composed of a plurality of pieces. The suit can also include yokes of various materials in the form of elastic fabrics, for example. The suit is preferably a wetsuit completely adjusted, or fitted, to the user's body.

To enable the user to put on and remove the suit easily, the suit is provided with an opening provided in the form of a slit 26 made in the torso-forming part 12, this slit being further provided with a fastening mechanism. For example, the fastening mechanism is formed of a slide fastener, such as a zipper, of the toothed type or the coiled spring type.

In the example shown in the drawing figures, the slit 26 is formed in the rear panel 18 of the torso part 12, and it is provided with a zipper 28 which can be operated by pulling on a flexible cord 30.

Advantageously, this slit 26 can be provided to extend at an angle with respect to the vertical, such as at an angle to a longitudinal median plane of the panel 18, as shown. In addition, the slit can be given a curved shape, at least in an upper section. It extends upward from a central zone of the rear panel 18 and opens out into the opening 20 for the passage of the head by being transversely offset with respect to the longitudinal median plane of the panel. Thus, the slit 26 demarcates two flaps of the rear panel and, in the open position of the fastening mechanism 28, the two flaps are transversely spaced apart to allow entry of the user's body into the suit.

Due to its inclination and/or its curved shape, the slit 26 opens out to the opening 20 for the passage of the head, not at the center as is known, but on one side, i.e., in the area of one of the shoulders 18 of the garment. This shape of the slit 26 has numerous advantages, particularly in terms of the ease of manipulation during the opening and fastening of the associated zipper 28, In the example shown, the zipper has a rectilinear lower section, which extends substantially over half of the length of the zipper, and a curved upper section.

According to the teachings of the invention, the suit 10 includes an internal collar 32, a main portion 34 of which is provided to surround the user's neck, the collar 32 being fixed to an inner surface of the torso-forming part 12. The main portion 34 of the collar can be given a tubular or truncated shape, and it can be made from a material that is sufficiently flexible to allow its passage above the user's head, and to allow its complete adaptation to the user's neck. It ensures complete imperviousness, without overly tightening the user's neck, by preventing water from passing between the neck and the main portion.

The collar further includes a lower portion 36 that covers the base of the neck and the shoulders 18, and which extends slightly downward at the rear and at the front, along the back and along the chest of the user, respectively. This lower portion 36 is adapted to be covered by the torso-forming main part 12 of the suit. Conversely, the main portion 34 is adapted to extend upward through the opening 20 for the passage of the head (at least when the torso-forming part does not have a neck and has an opening 20 arranged in the area of the base of the neck, as shown in the drawing figures).

In the back, the collar 32 includes a sealing portion 38 that extends the lower portion 36 downward so as to be positioned opposite the slit 26 and the associated zipper. This sealing portion 38 prevents water from directly coming into contact with the user in the event the water were to infiltrate through the zipper 28. Furthermore, by being inserted between the zipper and the user's skin, the sealing portion 38 forms a padding that improves the comfort of the suit.

The main qualities required for the material(s) from which the collar is(are) made are flexibility and imperviousness. Because the qualities of thermal insulation can be considered less important, thin polychloroprene foams, for example, can be used.

Figure 7:
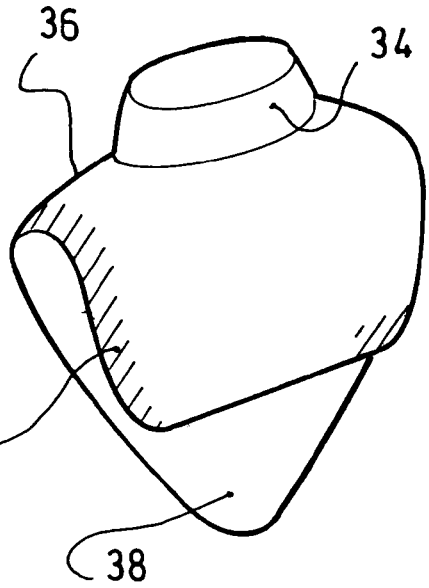
FIGS. 5, 6, and 7 are front, rear, and three-quarter front views, respectively, showing the collar alone, with an indication of the areas for fixing to the inner surface of the garment.
Figure 5:
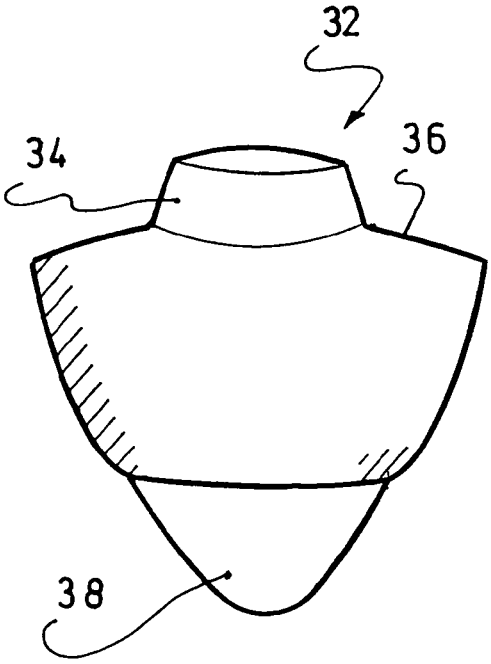
Figure 6:
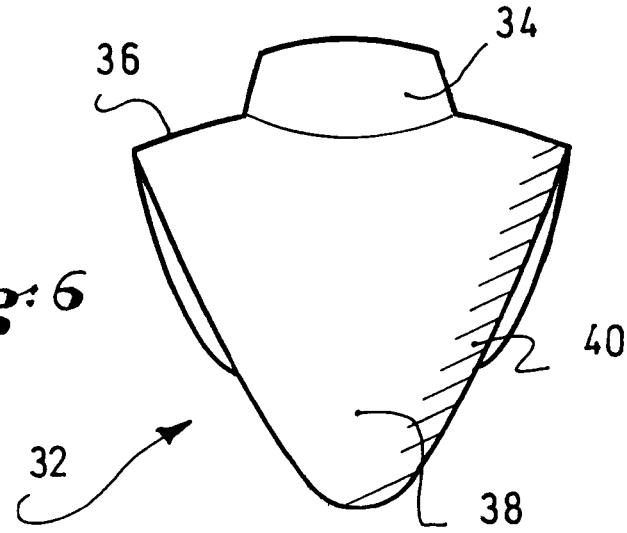

By means of cross-hatching, FIGS. 5–7 show the area(s) or zone(s) 40 of the collar for fixing the collar to the inner surface of the torso-forming part. In the example shown, these fixing zone(s) extend essentially on one of the lateral edges, the right edge in the illustrated case, so as to fix the collar mainly under the right shoulder of the suit, but also, still on the right side, on the chest and on the back, along the slit 26. In the illustrated embodiment of the invention, the fixing zones extend down to the lower end of the sealing portion 38. With this configuration, the opposing edge of the collar 32, the left edge in the illustrated case, is completely free with respect to the suit, such that it is possible, as shown in FIG. 4, to move the collar 32 transversely in order to retract it under the right shoulder 18 of the garment, thus freeing the opening demarcated by the slit 26 and by the opening 20. During this operation, the collar 32 is retracted inside the volume demarcated by the torso-forming part 12.

In this position, the user can slip into the suit and wear it completely. Once the suit is put on, but prior to closing the slit 26, the user can grab the collar 32 and pass it above his/her head in the manner of a necklace or a hood. Thereafter, the position of the lower portion 36 and the position of the sealing portion 38 of the collar 32 must be adjusted prior to fastening the zipper 28.

Due to the invention, the adjustment of the torso-forming part 12 of the garment is used to create a force that tends to press the part 12 on the collar 32, and the collar 32 against the user's body. Thus, the pressing is completely achieved under any circumstances, which makes it possible to guarantee imperviousness.

Figure 8:
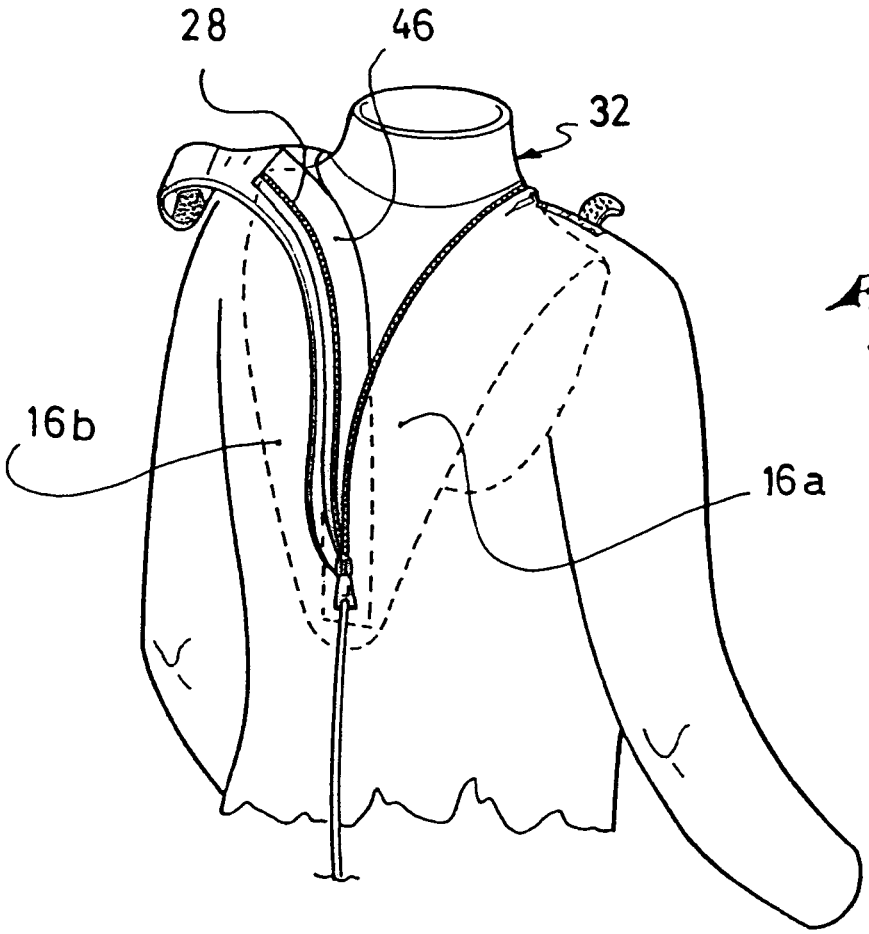
FIG. 8 is an enlarged view of FIG. 3, showing in more detail the rear slit and the associated fastening mechanism.
Figure 9:
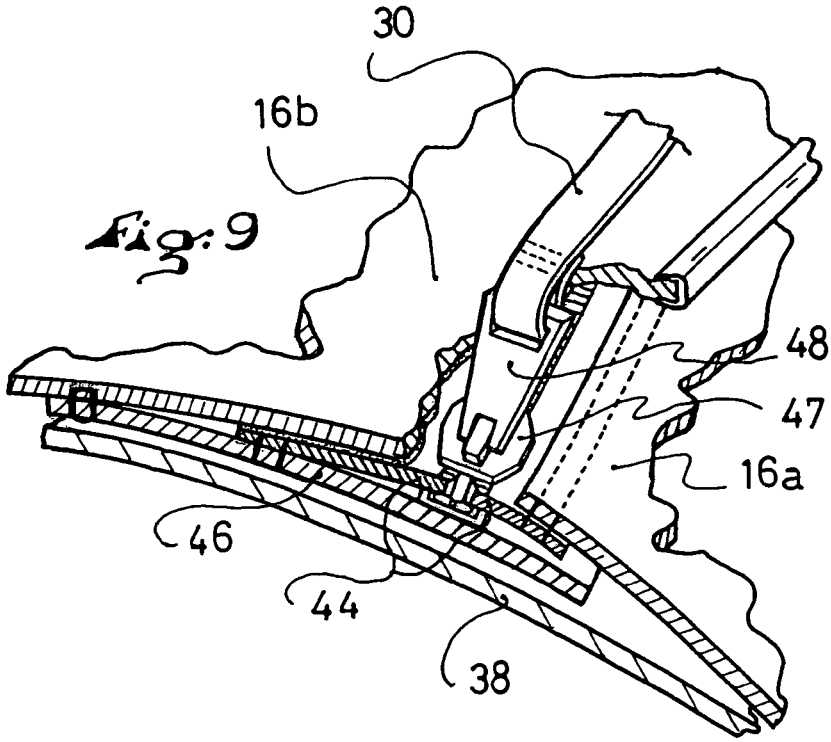
FIG. 9 is a schematic view showing more precisely the construction and assembly of the mechanism for closing and sealing the slit.

The design of the sealing arrangement is shown more particularly in FIGS. 8 and 9. The zipper 28 is a conventional zipper comprising two strips 44 each provided with a series of teeth, which are adapted to nest into one another to provide the closure. The nesting and unnesting of the teeth are controlled, as known, by a slider 47 provided with a pull tab 48.

In these drawing figures, it is seen that the collar 32 is fixed to a first flap, in this case the right flap 16*a*. One of the strips 44 of the zipper 28 is directly fixed to the inner surface of the right flap 16*a*. The second strip is fixed to the outer surface of a protective flap 46 (made in the form of a band, such as from NEOPRENE®), which flap 46 is fixed to the left flap 16*b*, along the slit 26. The width of the flap 46 is such that, when the garment is fastened, it completely covers the zipper 28, on the inner side, and, therefore, partially overlaps the right flap 16*a* on the inner side. As seen in FIG. 9, the sealing portion 38 of the collar 32 completes the device and covers the assembly previously described from the inside. The whole forms a baffle construction which, once pressed against the user's back, makes it possible to guarantee imperviousness in the area of the slit 26. It is further noted that the left flap 16*b* is provided such that, when the slit is closed by the zipper 28, the left flap 16 completely covers the zipper from the outside and overlaps the right flap 16*a* over several centimeters from the outside.

The zones for fixing the collar 32 could be distributed differently, for a different positioning, where the fixing zones 40 described hereinabove could be completed by other fixing points. Thus, in the example shown, one can envision that the left edge, in its lowermost portions, at the front and/or at the rear, comprise gluing points on the inner surface of the torso-forming part 12. Perhaps, the retraction of the collar 32 may not be as easy at the time the suit is put on, but the positioning of the collar 32 prior to closing the suit is considerably facilitated.

The fixing of the collar 32 to the inner surface of the suit is done by any appropriate means, depending on the materials constituting the collar 32 and the torso-forming part 12. In the case of NEOPRENE®, one can chose to make this fixing, for example, by stitching and/or gluing.

As can be seen more particularly in FIGS. 1 and 4, one of the flaps demarcated by the slit 26 comprises, in the area of the opening 20 for the passage of the head, a fastening tab 42 that is adapted to overlap the slit 26 so as to be attached to the opposing flap. In a particular arrangement, the fastening tab 42 and the opposing flap are provided with self-gripping bands (such as VELCRO®) that allow for a plurality of fastening positions, as a result of which the user can completely adjust the tightening of the opening 20 around his/her neck to guarantee imperviousness.

What is claimed is:

1. A garment for aquatic sports comprising:

a torso-forming part comprising:

a front panel;

a rear panel;

at least one opening for passage of a wearer's head;

a slit and a fastening mechanism for selectively opening and closing the slit;

an internal collar comprising a main portion adapted to surround the wearer's neck, the internal collar being fixed to an inner surface of the torso-forming part;

the collar comprising a sealing portion extending along the slit of the torso-forming part, against an inner surface of the torso-forming part;

said slit having a lowermost extremity and said sealing portion extending downward beneath the lowermost extremity of the slit.

2. A garment according to claim 1, wherein:

the collar is fixed to the inner surface of the torso-forming part in one or more areas of the inner surface to enable the internal collar to be moved beneath a shoulder of the garment.

3. A garment according to claim 2, wherein:

the one or more areas of the inner surface of the torso-forming part extend substantially on a lateral edge of the collar.

4. A garment according to claim 3, wherein:

the one or more areas for fixing the collar that extend substantially on a lateral edge of the collar are completed by other fixing points.

5. A garment according to claim 4, wherein:

an opposing lateral edge of the collar is free from attachment to the torso-forming part.

6. A garment according to claim 1, wherein:

the collar comprises a lower portion for covering a base of the neck of the wearer, the lower portion of the collar being covered by the torso-forming part and extending through the opening for the passage of the head.

7. A garment according to claim 6, wherein:

the lower portion of the collar extends downward at the rear and at the front, along the back and along the chest of the wearer, respectively.

8. A garment according to claim 6, wherein:

the lower portion of the collar at least partially covers the wearer's shoulders.

9. A garment according to claim 1, wherein:

the main portion of the collar is fixed in an area of a shoulder of the torso-forming part of the garment.

10. A garment according to claim 6, wherein:

the lower portion of the collar comprises points for fixing to at least one of the front or rear panels of the torso-forming part of the garment.

11. A garment according to claim 1, wherein:

the slit extends upward from a central zone of the rear panel and opens out in the opening for the passage of the wearer's head so as to demarcate two flaps of the rear panel; and in the open position of the fastening mechanism, the two flaps are transversely spaced apart to allow entry of the wearer's body into the garment.

12. A garment according to claim 11, wherein:

the sealing portion comprises a fixing zone extending on at least one of the two flaps along the slit.

13. A garment according to claim 1, wherein:

the opening for the passage of the head is defined at least in part by an upper edge of the front panel and an upper edge of the rear panel, the opening extending substantially in an area of a base of the wearer's neck.

14. A garment according to claim 1, wherein:

the fixing of the internal collar to the inner surface of the torso-forming part comprises stitches and/or glue.

15. A garment for aquatic sports comprising:

a torso-forming part comprising:

a front panel;

a rear panel;

at least one opening for passage of a wearer's head;

a slit and a fastening mechanism for selectively opening and closing the slit;

an internal collar comprising a main portion adapted to surround the wearer's neck, the internal collar being fixed to an inner surface of the torso-forming part;

the collar being fixed to the inner surface of the torso-forming part in one or more areas of the inner surface to enable the internal collar to be moved beneath a shoulder of the garment.

16. A garment according to claim 15, wherein:

the one or more areas of the inner surface of the torso-forming part extend substantially on a lateral edge of the collar.

17. A garment according to claim 16, wherein:

the one or more areas for fixing the collar that extend substantially on a lateral edge of the collar are completed by other fixing points.

18. A garment according to claim 17, wherein:

an opposing lateral edge of the collar is free from attachment to the torso-forming part.

19. A garment for aquatic sports comprising:

a torso-forming part comprising:

a front panel;

a rear panel;

at least one opening for passage of a wearer's head;

a slit and a fastening mechanism for selectively opening and closing the slit;

an internal collar comprising a main portion adapted to surround the wearer's neck, the internal collar being fixed to an inner surface of the torso-forming part;

the slit extending upward from a central zone of the rear panel and opening out in the opening for the passage of the wearer's head so as to demarcate two flaps of the rear panel; and in the open position of the fastening mechanism, the two flaps being transversely spaced apart to allow entry of the wearer's body into the garment.

20. A garment according to claim 19, wherein:

the sealing portion comprises a fixing zone extending on at least one of the two flaps along the slit.

* * * * *